US005630712A

United States Patent [19]

Sakai et al.

[11] Patent Number: 5,630,712

[45] Date of Patent: May 20, 1997

[54] ELECTRICALLY-DRIVEN CLOSED SCROLL COMPRESSOR HAVING MEANS FOR MINIMIZING AN OVERTURNING MOMENT TO AN ORBITING SCROLL

[75] Inventors: Manabu Sakai; Shigeru Muramatsu, both of Kusatsu, Japan

[73] Assignee: Matsushita Electric Industrial Co., Ltd., Osaka, Japan

[21] Appl. No.: 515,591

[22] Filed: Aug. 16, 1995

[30] Foreign Application Priority Data

Aug. 22, 1994 [JP] Japan ..... 6-195838

[51] Int. Cl.[6] ..... F04C 18/04; F04C 27/00

[52] U.S. Cl. ..... 418/55.4; 418/55.5; 418/57

[58] Field of Search ..... 418/55.4, 55.5, 418/57

[56] References Cited

U.S. PATENT DOCUMENTS

| | | | |
|---|---|---|---|
| 4,522,575 | 6/1985 | Tischer et al. | 418/57 |
| 4,992,032 | 2/1991 | Barito et al. | 418/55.4 |
| 5,085,565 | 2/1992 | Barito | 418/55.4 |

FOREIGN PATENT DOCUMENTS 3-149382 6/1991 Japan .

*Primary Examiner*—John J. Vrablik
*Attorney, Agent, or Firm*—Wenderoth, Lind & Ponack

[57] ABSTRACT

An electrically-driven closed scroll compressor has a compression mechanism accommodated in a closed vessel. The compression mechanism includes a bearing member securely mounted in the closed vessel, a stationary scroll having a stationary scroll wrap formed thereon, an orbiting scroll having an orbiting end plate and an orbiting scroll wrap formed on the orbiting end plate so as to engage with the stationary scroll wrap to define a plurality of working pockets therebetween, and an eccentric bearing for allowing the orbiting scroll to undergo an orbiting motion relative to the stationary scroll. A generally ring-shaped sealing member is mounted on the bearing member so as to be held in contact with the orbiting end plate. The sealing member may be mounted on the orbiting end plate. The orbiting end plate has first and second regions defined therein internally and externally of the sealing member, respectively, so that the first and second regions may receive first and second pressures, respectively, both forming a first thrust force. The sealing member has a center positioned so that during the orbiting motion of the orbiting scroll, when a second thrust force applied to the orbiting scroll from the working pockets takes a substantially maximum value, a distance between a central point of application of the first thrust force and a central point of application of the second thrust force takes a substantially minimum value.

5 Claims, 14 Drawing Sheets

ELECTRICALLY-DRIVEN CLOSED SCROLL COMPRESSOR HAVING MEANS FOR MINIMIZING AN OVERTURNING MOMENT TO AN ORBITING SCROLL

BACKGROUND OF THE INVENTION

1. Field of the Invention

The present invention relates to an electrically-driven closed scroll compressor for use in, for example, an air conditioner, a refrigerator or the like.

2. Description of Related Art

Japanese Laid-open Patent Publication (unexamined) No. 3-149382 discloses a generally available electrically-driven closed scroll compressor as shown in FIGS. 14 to 17.

Referring to FIG. 14, a compression mechanism 102, an electric motor (not shown), and a crank shaft 103 for transmitting a rotational force of the electric motor to the compression mechanism 102 are accommodated within a closed vessel 101. The closed vessel 101 is provided with a suction pipe 104 rigidly secured thereto for introducing a low-pressure refrigerant thereinto and with a discharge pipe (not shown) rigidly secured thereto for discharging a high-pressure refrigerant compressed by the compressor mechanism 102 to the outside of the closed vessel 101.

The scroll compressor shown in FIG. 14 operates as follows.

The rotational force generated by the operation of the electric motor is transmitted to the compression mechanism 102 via the crank shaft 103 and causes an eccentric bearing 105 to undergo an eccentric rotational motion. The eccentric bearing 105 rotatably supports an orbiting shaft 107 of an orbiting scroll 106. An Oldham ring 108 is provided to prevent the orbiting scroll 106 from rotating about its own axis while permitting it to undergo an orbiting motion relative to a stationary scroll 109 with the orbiting and stationary scrolls 106 and 109 being in engagement with each other.

As a result, the low-pressure refrigerant introduced into the closed vessel 101 through the suction pipe 104 passes through a suction port 110 defined in the compression mechanism 102 and is trapped into two volume-variable and radially symmetric working pockets 111 defined between an orbiting scroll wrap 117 of the orbiting scroll 106 and a stationary scroll wrap 118 of the stationary scroll 109. Then, the refrigerant trapped into each working pocket 111 experiences a decrease in volume and an increase in pressure as it approaches a center discharge port 112 and is subsequently discharged into a high-pressure chamber 119 through the center discharge port 112 and then to the outside of the closed vessel 101 through the discharge pipe.

FIGS. 15A to 15D depict a compression process during which the refrigerant trapped in the working pockets 111 is compressed by the compression mechanism 102. FIG. 15A indicates the state at an orbiting angle of 0° at which the introduction of the low-pressure refrigerant into the two working pockets 111, particularly identified by A and B, is completed. FIGS. 15B and 15C indicate the states at orbiting angles of 90° and 180°, respectively, and also indicate a progressive reduction in volume of the working pockets 111 (A and B). FIG. 15D indicates the state at an orbiting angle of 270° at which the two working pockets 111 communicate with the center discharge port 112 so that the high-pressure refrigerant may be discharged from the center discharge port 112.

The pressure of the refrigerant inside the working pockets 111 acts to apply an axial or thrust force FI to the orbiting scroll 106 to move or float it away from the stationary scroll 109, and the magnitude of the thrust force FI varies continuously during the orbiting motion of the orbiting scroll 106. This thrust force FI is hereinafter referred to as a floating force. On the other hand, an orbiting end plate 113 of the orbiting scroll 106 confronts a flat portion 115 of a generally ring-shaped bearing member 114 secured to the stationary scroll 109 and is held in contact with a ring-shaped sealing member 116, which is received in a recess defined in the bearing member 114 on the flat portion 115 thereof and is coaxially aligned with the bearing member 114. That region on the orbiting end plate 113 which is defined internally of the sealing member 116 receives the pressure of the high-pressure refrigerant, while that region on the orbiting end plate 113 which is defined externally of the sealing member 116 receives an intermediate pressure between the pressure of the low-pressure refrigerant and that of the high-pressure refrigerant. The intermediate pressure can be obtained by communicating a space defined on one side of the bearing member 114, in which space the pressure of the high-pressure refrigerant acts, with another space defined on the other side of the bearing member 114, in which space the pressure of the low-pressure refrigerant acts, through a through-hole of a small diameter defined in the bearing member 114. Accordingly, it is possible to determine the magnitude of an axial or thrust force FO, which the refrigerant applies to the orbiting scroll 106 from the side of the sealing member 116 so as to press the orbiting scroll 106 against the stationary scroll 109, to a predetermined one by appropriately selecting the diameter of the sealing member 116, i.e. the area of the inner region. This thrust force FO is hereinafter referred to as a pressing force. The magnitude of the pressing force FO depends on only the pressure of the high-pressure refrigerant and the intermediate pressure between the pressure of the low-pressure refrigerant and that of the high-pressure refrigerant and is made constant during the orbiting motion of the orbiting scroll 106.

FIG. 16 schematically depicts a relationship between the floating force FI and the pressing force FO as viewed from the working pockets 111 towards the orbiting scroll wrap 117.

As shown in FIG. 16, a central point Fo of application of the pressing force FO moves so as to draw a circular orbit Do around a point P as the orbiting scroll 106 undergoes an orbiting motion. Because the sealing member 116 is coaxially aligned with the bearing member 114, the radius of the circular orbit Do is equal to an orbiting radius of the orbiting scroll 106, while the central point P of the circular orbit Do coincides with a central point O of the orbiting end plate 113 of the orbiting scroll 106. On the other hand, a central point Fi of application of the floating force FI moves so as to draw a circular orbit Di around a central point Q of development of a scroll curve forming the orbiting scroll wrap 117. Because the two working pockets 111 are radially symmetric, the radius of the circular orbit Di is equal to half the orbiting radius of the orbiting scroll 106. The pressing force FO is directed 180° opposite to the floating force FI, and the central point Fo of application of the former is spaced a distance L from that Fi of the latter. This distance L varies with the orbiting motion of the orbiting scroll 106.

Because the orbiting and stationary scroll wraps 117 and 118 defining the working pockets 111 therebetween are formed so as to represent respective involute curves of a circle, the central point Q of development of the scroll curve referred to above is a central point of a basic circle of the involute curve which the orbiting scroll wrap 117 represents.

Also, because the central point Fo of application of the pressing force FO is spaced a distance L from that Fi of the floating force FI, the orbiting scroll 106 receives an overturning moment M in proportion to a value obtained by multiplying the floating force FI by the distance L.

FIG. 17 depicts a relationship among the pressing force FO, floating force FI, distance L, and overturning moment M with the axis of abscissa indicating an orbiting angle of the orbiting scroll 106. An orbiting angle of 0° is an angle at which the introduction of the low-pressure refrigerant into the working pockets 111 is completed, and corresponds to the state of FIG. 15A. An orbiting angle of α° indicating a maximum floating force FI is an angle at which the working pockets 111 communicate with the center discharge port 112 defined in the orbiting scroll 106, and coincides substantially with an orbiting angle at which the distance L between the central point Fi of application of the floating force FI and the central point Fo of application of the pressing force FO is maximum. The floating force FI is minimum at an orbiting angle of β°.

Because the overturning moment M acting on the orbiting scroll 106 is proportional to the value obtained by multiplying the floating force FI by the distance L, the overturning moment M becomes very large at the orbiting angle of α° and takes a maximum value Mmax.

If a very large overturning moment M acts on the orbiting scroll 106, contact of the orbiting scroll 106 with the stationary scroll 109 cannot be maintained normal. As a result, the orbiting scroll 106 undergoes an orbiting motion in its inclined state, and leakage of the compressed refrigerant takes place between neighboring working pockets 111, resulting in a reduction in volume efficiency.

Also, biased contact takes place between the orbiting shaft 107 of the orbiting scroll 106 and the eccentric bearing 105 or between an outer peripheral portion of the orbiting end plate 113 of the orbiting scroll 106 and the stationary scroll 109, thus increasing wear and reducing the duration of life of the compressor itself. The biased contact also causes abnormal noise or vibration.

Furthermore, if a sealing member 116 having a relatively large diameter is mounted on the bearing member 114 to enlarge the pressing force FO and restrain a large overturning moment M from acting on the orbiting scroll 106 so that contact between the orbiting and stationary scrolls 106 and 109 may be always maintained normal during the orbiting motion of the orbiting scroll 106, a large sliding loss is generated on a contact area between the orbiting end plate 113 of the orbiting scroll 106 and the stationary scroll 109, resulting in a reduction in mechanical efficiency.

SUMMARY OF THE INVENTION

The present invention has been developed to overcome the above-described disadvantages.

It is accordingly an objective of the present invention to provide an electrically-driven closed scroll compressor capable of minimizing an overturning moment acting on an orbiting scroll.

Another objective of the present invention is to provide the scroll compressor of the above-described type which does not bring about a reduction in volume efficiency, a reduction in duration of life, and a reduction in mechanical efficiency, even if the overturning moment acts on the orbiting scroll, and which generates less noise or vibration.

In accomplishing the above and other objectives, the scroll compressor of the present invention comprises a closed vessel, a compression mechanism accommodated in the closed vessel, and an electric motor accommodated in the closed vessel so as to drive the compression mechanism, said compression mechanism comprising a bearing member securely mounted in the closed vessel, a stationary scroll having a stationary scroll wrap formed thereon, an orbiting scroll having an orbiting end plate and an orbiting scroll wrap formed on the orbiting end plate so as to engage with the stationary scroll wrap to define a plurality of working pockets therebetween, and an eccentric bearing for allowing the orbiting scroll to undergo an orbiting motion relative to the stationary scroll. A generally ring-shaped sealing member is mounted on the bearing member so as to be held in contact with the orbiting end plate.

The orbiting end plate has first and second regions defined therein internally and externally of the sealing member, respectively, so that the first and second regions may receive first and second pressures, respectively, both forming a first thrust force. The sealing member has a center positioned so that during the orbiting motion of the orbiting scroll, when a second thrust force applied to the orbiting scroll from the working pockets takes a substantially maximum value, a distance between a central point of application of the first thrust force and a central point of application of the second thrust force takes a substantially minimum value.

Advantageously, the center of the sealing member is radially offset from a center of the bearing member.

Conveniently, the first pressure is equal to the pressure of a high-pressure refrigerant discharged from the compression mechanism, while the second pressure is equal to the pressure of a low-pressure refrigerant introduced into the compression mechanism.

Alternatively, the generally ting-shaped sealing member may be mounted on the orbiting end plate so as to be held in contact with the bearing member.

In this case, it is preferred that the center of the sealing member is radially offset from a center of the orbiting end plate so that the central point of application of the first thrust force is positioned within a circular orbit which the central point of application of the second thrust force draws during the orbiting motion of the orbiting scroll.

Again alternatively, the orbiting scroll wrap is formed to represent a scroll curve having a center of development positioned on the orbiting end plate so that during the orbiting motion of the orbiting scroll, when a second thrust force applied to the orbiting scroll from the working pockets takes a substantially maximum value, a distance between a central point of application of the first thrust force and a central point of application of the second thrust force takes a substantially minimum value

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
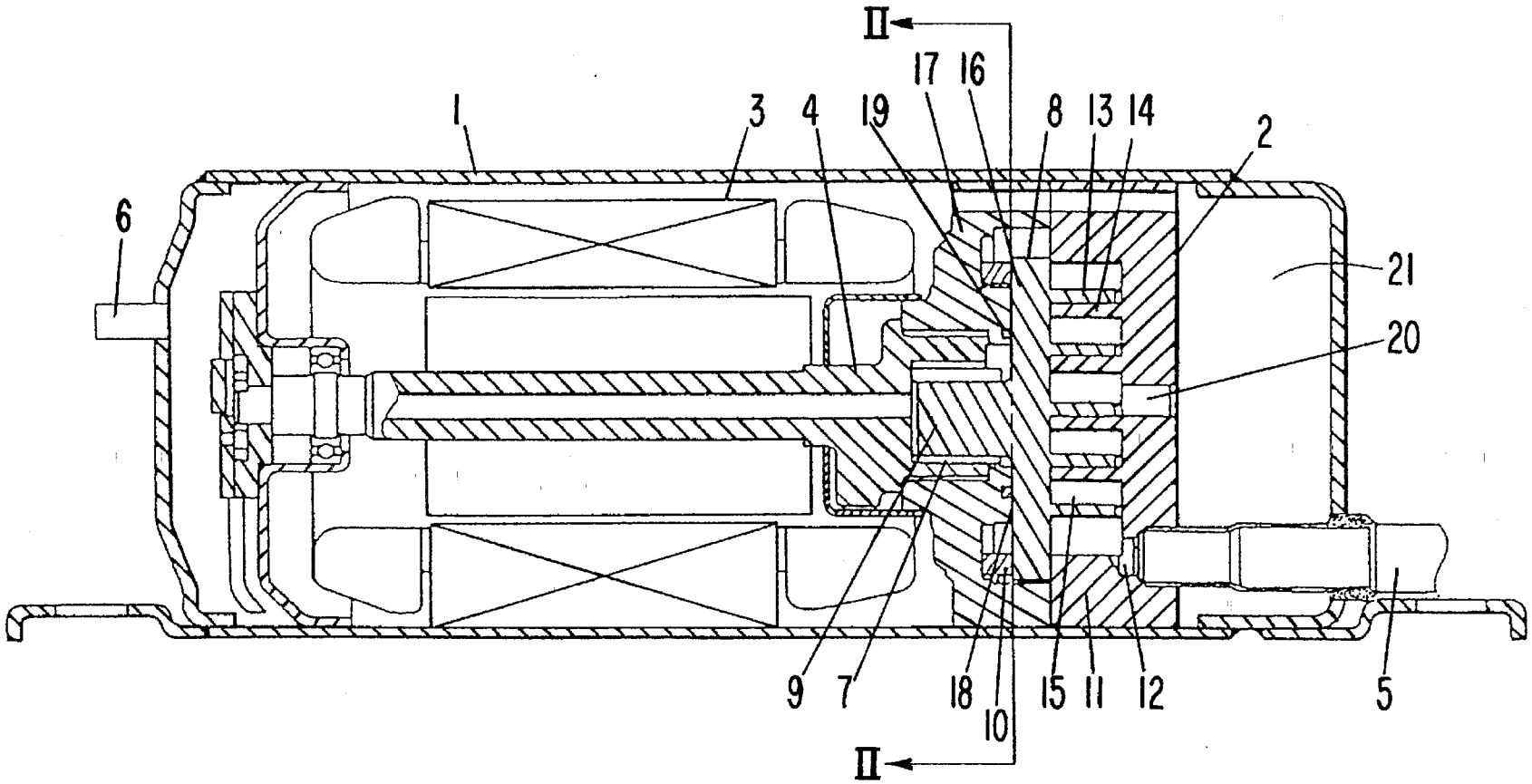
FIG. 1 is a vertical sectional view of an electrically-driven closed horizontal scroll compressor according to a first embodiment of the present invention.

Referring now to the drawings, there is shown in FIG. 1 an electrically-driven closed horizontal scroll compressor according to a first embodiment of the present invention.

The scroll compressor shown in FIG. 1 comprises a compression mechanism 2, an electric motor 3, and a crank shaft 4 for transmitting a rotational force of the electric motor 3 to the compression mechanism 2, all of which are accommodated within a closed vessel 1. The closed vessel 1 is provided with a suction pipe 5 rigidly secured thereto for introducing a low-pressure refrigerant thereinto and with a discharge pipe 6 rigidly secured thereto for discharging a high-pressure refrigerant compressed by the compression mechanism 2 to the outside of the closed vessel 1.

The rotational force generated by the operation of the electric motor 3 is transmitted to the compression mechanism 2 via the crank shaft 4 and causes an eccentric bearing 7 mounted in the compression mechanism 2 to undergo an eccentric rotational motion. An orbiting shaft 9 of an orbiting scroll 8 is journaled in the eccentric bearing 7. An Oldham ring 10 is provided to prevent the orbiting scroll 8 from rotating about its own axis while permitting it to undergo an orbiting motion relative to a stationary scroll 11 with the orbiting and stationary scrolls 8 and 11 being in engagement with each other.

The low-pressure refrigerant introduced into the closed vessel 1 through the suction pipe 5 passes through a suction port 12 defined in the compression mechanism 2 and is trapped into a plurality of volume-variable and radially symmetric working pockets 15 defined between an orbiting scroll wrap 13 of the orbiting scroll 8 and a stationary scroll wrap 14 of the stationary scroll 11. The orbiting motion of the orbiting scroll 8 causes the working pockets 15 to move inwardly around the orbiting and stationary scroll wraps 13 and 14 towards a center discharge port 20 defined in the stationary scroll 11, accompanied by a progressive reduction in volume thereof. Therefore, the refrigerant trapped into each working pocket 15 experiences a decrease in volume and an increase in pressure as it approaches the center discharge port 20 and is subsequently discharged into a high-pressure chamber 21 through the center discharge port 20 and then to the outside of the closed vessel 1 through the discharge pipe 6.

When the working pockets 15 communicate with the center discharge port 20, a thrust force or floating force FI acts on the orbiting scroll 8 from the side of the working pockets 15. Because the pressure and volume inside the working pockets 15 vary with the orbiting motion of the orbiting scroll 8, the magnitude of the floating force FI varies continuously during the orbiting motion of the orbiting scroll 8.

On the other hand, an orbiting end plate 16 of the orbiting scroll 8 confronts a flat portion 18 of a generally ring-shaped bearing member 17 secured to the stationary scroll 11 and is held in contact with a ring-shaped sealing member 19 received in a recess defined in the bearing member 17 on the flat portion 18 thereof. That region on the orbiting end plate 16 which is defined internally of the sealing member 19 receives the pressure of the high-pressure refrigerant discharged from the center discharge port 20 of the compression mechanism 2, while that region on the orbiting end plate 16 which is defined externally of the sealing member 19 receives the pressure of the low-pressure refrigerant introduced into the compression mechanism 2. Because of this, a thrust force or pressing force FO acts on the orbiting scroll 8 from the side of the sealing member 19. The magnitude of the pressing force FO depends on only the pressure of the high-pressure refrigerant acting on the internal region of the sealing member 19 and the pressure of the low-pressure refrigerant acting on the external region of the sealing member 19, and is therefore constant during the orbiting motion of the orbiting scroll 8.

Figure 2:
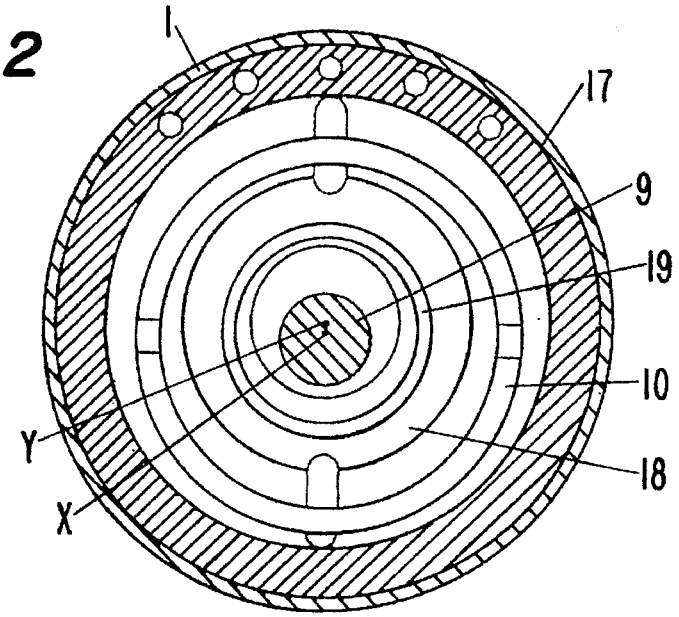
FIG. 2 is a sectional view taken along line II—II in FIG. 1.

As shown in FIG. 2, the sealing member 19 has a central point X radially offset from a central point Y of the bearing member 17 so that during the orbiting motion of the orbiting scroll 8, a distance L between a central point Fi of application of the floating force FI acting on the orbiting scroll 8 and a central point Fo of application of the pressing force FO may become minimum at an orbiting angle at which the magnitude of the floating force FI is equal to or nearly equal to a maximum value.

Figure 5:
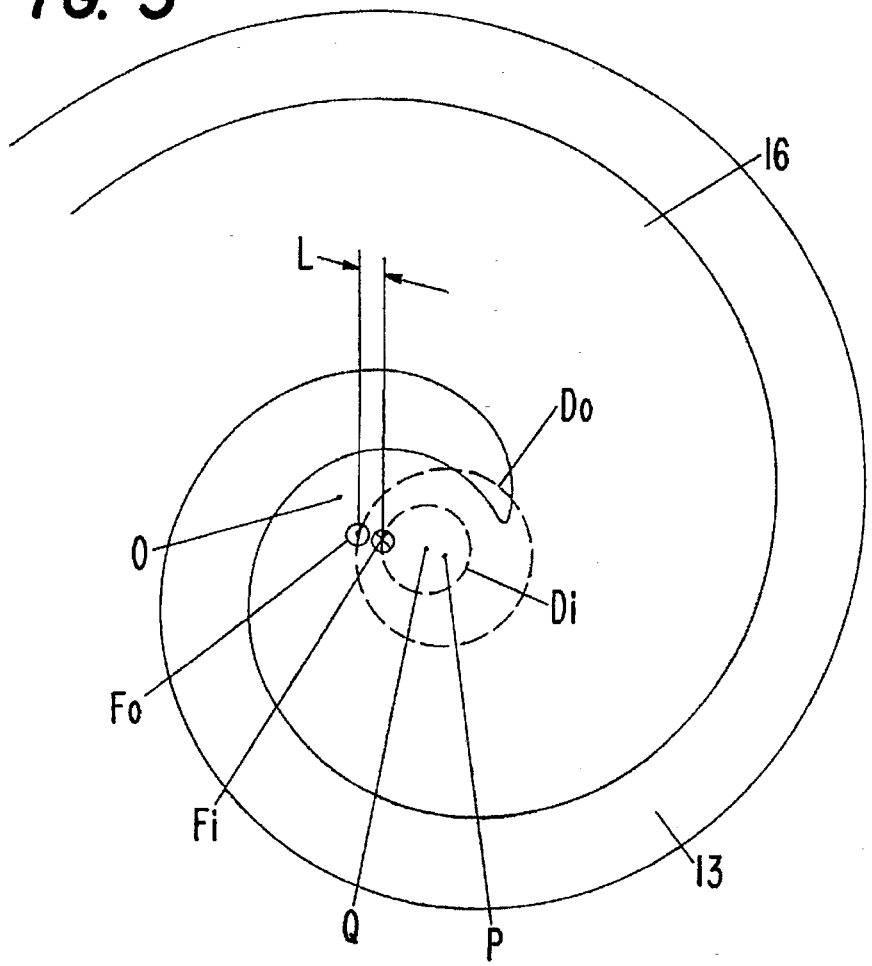
FIG. 5 is a fragmentary front view of an orbiting scroll mounted in the scroll compressor of FIG. 1, particularly indicating a relationship between a floating force and a pressing force both applied thereto.

More specifically, as shown in FIG. 5 indicating a relationship between the floating force FI and the pressing force FO as viewed from the working pockets 15 towards the orbiting scroll wrap 13, the central point Fo of application of the pressing force FO moves so as to draw a circular orbit Do around a point P as the orbiting scroll 8 undergoes an orbiting motion. The radius of the circular orbit Do is equal to an orbiting radius of the orbiting scroll 8. In FIG. 5, a point O denotes a central point of the orbiting end plate 16. On the other hand, the central point Fi of application of the floating force FI moves so as to draw a circular orbit Di around a central point Q of a basic circle of an involute curve of a circle forming the orbiting scroll wrap 13. Because the working pockets 15 are radially symmetric, the radius of the circular orbit Di is equal to half the orbiting radius of the orbiting scroll 8.

The pressing force FO is directed 180° opposite to the floating force FI, and the central point Fo of application of the former is spaced a distance L from that Fi of the latter. This distance L varies with the orbiting motion of the orbiting scroll 8. Because the central point Fo of application of the pressing force FO is spaced a distance L from that Fi of the floating force FI, an overturning moment M acting on the orbiting scroll 8 is proportional to a value obtained by multiplying the floating force FI by the distance L.

Figure 11:
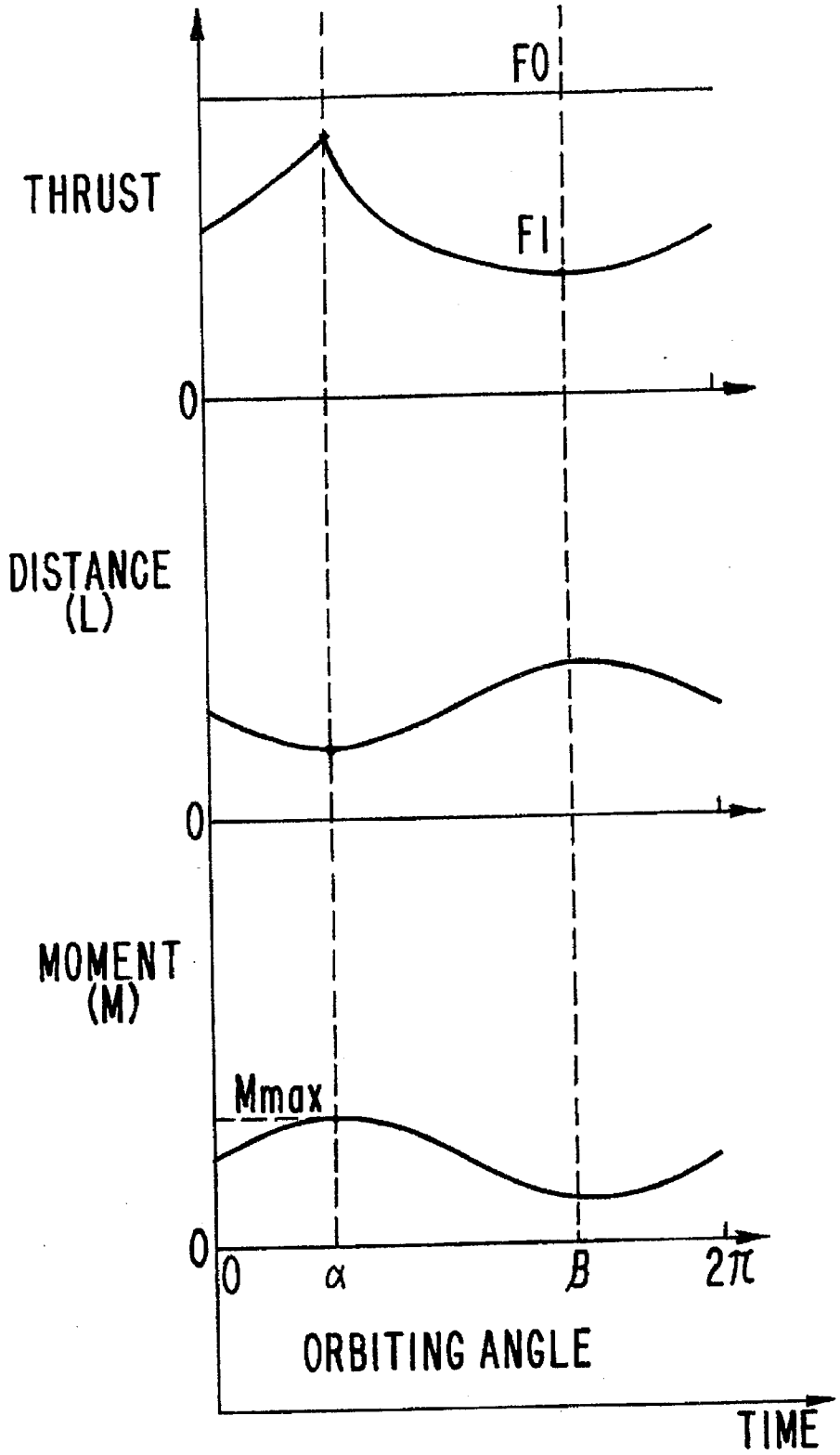
FIG. 11 is a graph indicating thrust forces and a moment both applied to the orbiting scroll according to the first or third embodiment of the present invention.

FIG. 11 depicts a relationship among the pressing force FO, floating force FI, distance L, and overturning moment M with the axis of abscissa indicating an orbiting angle of the orbiting scroll 8. An orbiting angle of 0° is an angle at which the introduction of the low-pressure refrigerant into the working pockets 15 is completed. Assuming that an orbiting angle at which the floating force FI is maximum is $\alpha°$ and an orbiting angle at which the floating force FI is minimum is $\beta°$, the distance L between the central point Fi of application of the floating force FI and the central point Fo of application of the pressing force FO is minimum at the orbiting angle of $\alpha°$. Accordingly, a waveform indicating a change in the floating force FI differs approximately 180° in phase from a waveform indicating a change in the distance L. In other words, when the floating force FI takes a maximum value or a value close thereto, the distance L takes a minimum value or a value close thereto, and when the floating force FI takes a minimum value or a value close thereto, the distance L takes a maximum value or a value close thereto. As described above, because the overturning moment M acting on the orbiting scroll 8 is proportional to a value obtained by multiplying the floating force FI by the distance L, a maximum value Mmax of the overturning moment M is maintained small and the amount of change thereof is considerably reduced.

Figure 3:
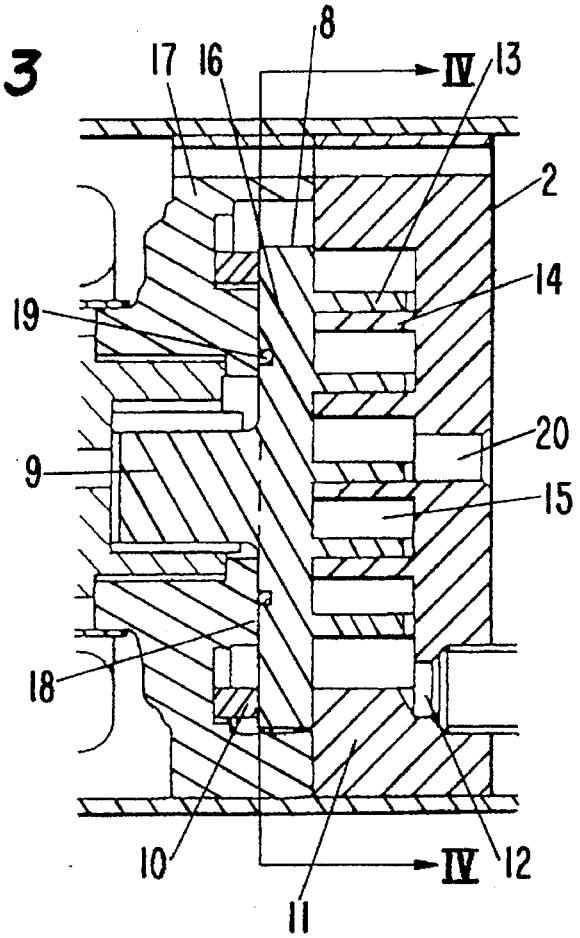
FIG. 3 is a fragmentary vertical sectional view of an essential portion of an electrically-driven closed horizontal scroll compressor according to a second embodiment of the present invention.

FIG. 3 depicts an electrically-driven closed horizontal scroll compressor according to a second embodiment of the present invention. Description of elements having the same construction and operation as those of the first embodiment is omitted for brevity's sake.

As shown in FIG. 3, a sealing member 19 is received in a recess defined in the orbiting end plate 16 on a generally flat surface thereof opposite to the orbiting scroll wrap 13 and confronting the flat portion 18 of the generally ring-shaped bearing member 17. That region on the orbiting end plate 16 which is defined internally of the sealing member 19 receives the pressure of the high-pressure refrigerant discharged from the center discharge port 20 of the compression mechanism 2, while that region on the orbiting end plate 16 which is defined externally of the sealing member 19 receives the pressure of the low-pressure refrigerant introduced into the compression mechanism 2. Because of this, a thrust force or pressing force FO acts on the orbiting scroll 8 from the side of the sealing member 19. The magnitude of the pressing force FO depends on only the pressure of the high-pressure refrigerant acting on the internal region of the sealing member 19 and the pressure of the low-pressure refrigerant acting on the external region of the sealing member 19, and is therefore constant during the orbiting motion of the orbiting scroll 8.

Figure 4:
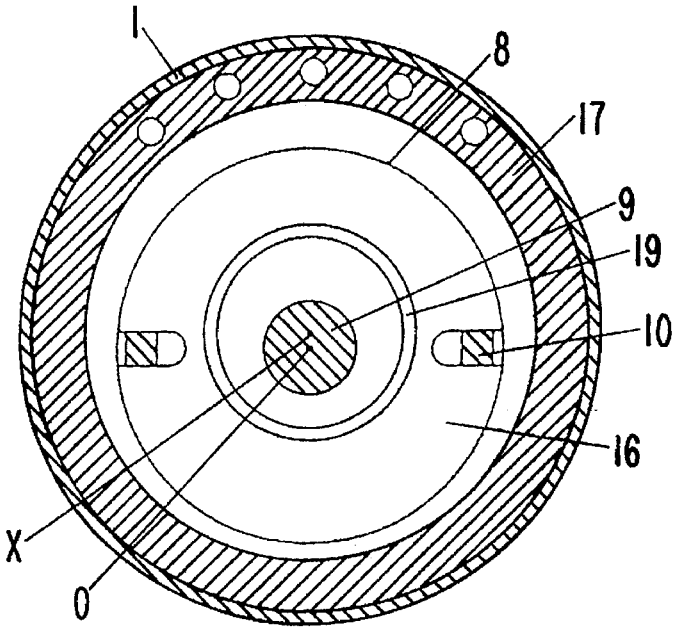
FIG. 4 is a sectional view taken along line IV—IV in FIG. 3.

As shown in FIG. 4, the sealing member 19 has a central point X radially offset from a central point O of the orbiting end plate 16 so that during the orbiting motion of the orbiting scroll 8, a distance L between a central point Fi of application of the floating force FI acting on the orbiting scroll 8 and a central point Fo of application of the pressing force FO may become minimum at an orbiting angle at which the magnitude of the floating force FI is equal to or nearly equally to a maximum value.

Figure 6:
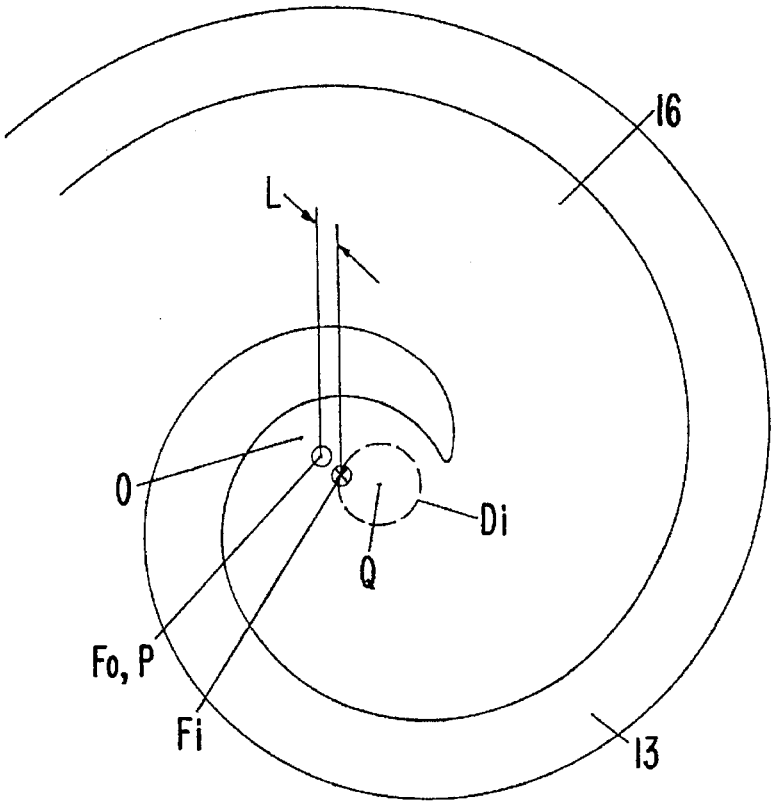
FIG. 6 is a view similar to FIG. 5, but according to the second embodiment of the present invention.

More specifically, as shown in FIG. 6 indicating a relationship between the floating force FI and the pressing force FO as viewed from the working pockets 15 towards the orbiting scroll wrap 13, the central point Fo of application of the pressing force FO always coincides with a central point P of a circular orbit resulting from the orbiting motion of the orbiting scroll 8. On the other hand, the central point Fi of application of the floating force FI moves so as to draw a circular orbit Di around a central point Q of a basic circle of an involute curve of a circle forming the orbiting scroll wrap 13. Because the working pockets 15 are radially symmetric, the radius of the circular orbit Di is equal to half the orbiting radius of the orbiting scroll 8.

Figure 12:
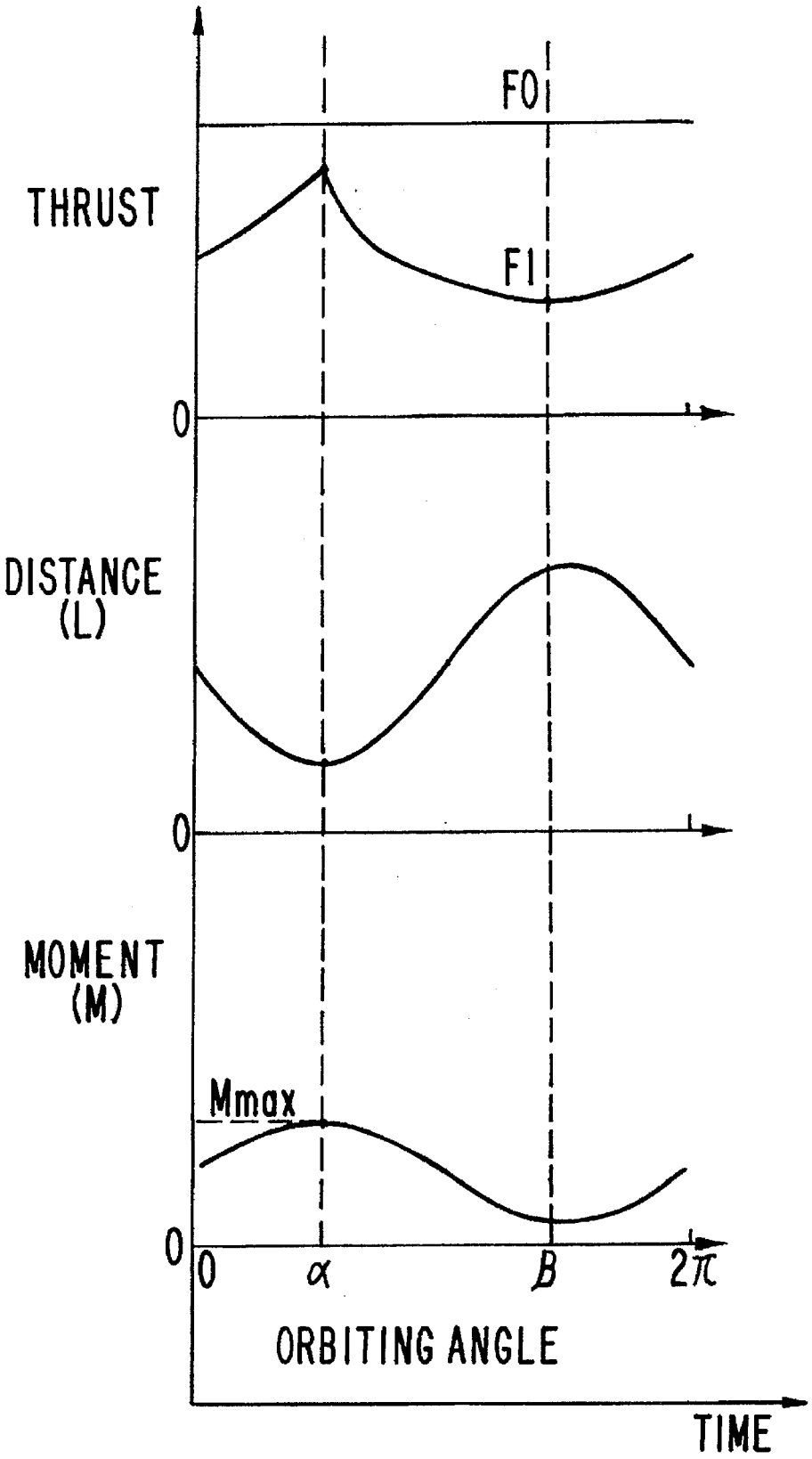
FIG. 12 is a graph similar to FIG. 11, but according to the second or fourth embodiment of the present invention.

FIG. 12 depicts a relationship among the pressing force FO, floating force FI, distance L, and overturning moment M relative to the orbiting angle of the orbiting scroll 8.

As clearly shown in FIG. 12, the distance L takes a minimum value or a value close thereto at an orbiting angle of $\alpha°$ at which the floating force FI takes a maximum value or a value close thereto, while the distance L takes a maximum value or a value close thereto at an orbiting angle of $\beta°$ at which the floating force FI takes a minimum value or a value close thereto. Accordingly, a maximum value Mmax of the overturning moment M is maintained small and the amount of change thereof is considerably reduced.

An electrically-driven closed horizontal scroll compressor according to a third embodiment of the present invention is hereinafter discussed with reference to FIGS. 7 and 11. Description of elements having the same construction and operation as those of the first embodiment is omitted for brevity's sake.

A ring-shaped sealing member 19 is concentrically aligned with the bearing member 17 and is received in a recess defined in the bearing member 17 on the flat portion 18 thereof confronting the orbiting end plate 16 of the orbiting scroll 8. That region on the orbiting end plate 16 which is defined internally of the sealing member 19 receives the pressure of the high-pressure refrigerant discharged from the center discharge port 20 of the compression mechanism 2, while that region on the orbiting end plate 16 which is defined externally of the sealing member 19 receives the pressure of the low-pressure refrigerant introduced into the compression mechanism 2. The center of development, i.e., the center Q of a basic circle of an involute curve of a circle forming the orbiting scroll wrap 13 is positioned on the orbiting end plate 16 so that during the orbiting motion of the orbiting scroll 8, a distance L between a central point Fi of application of the floating force FI acting on the orbiting scroll 8 and a central point Fo of application of the pressing force FO may become minimum at an orbiting angle at which the magnitude of the floating force FI is equal to or nearly equally to a maximum value.

Figure 7:
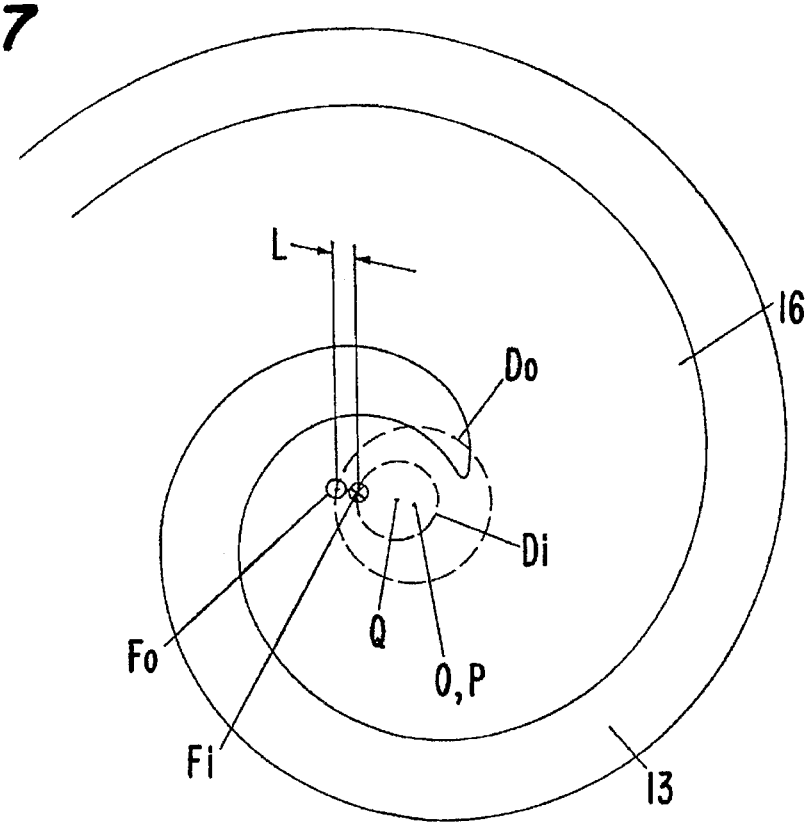
FIG. 7 is a view similar to FIG. 5, but according to a third embodiment of the present invention.

More specifically, as shown in FIG. 7 indicating a relationship between the floating force FI and the pressing force FO as viewed from the working pockets 15 towards the orbiting scroll wrap 13, the central point Fi of application of the floating force FI acting on the orbiting scroll 8 from the side of the working pockets 15 moves so as to draw a circular orbit Di of a radius equal to half the orbiting radius of the orbiting scroll 8 around the central point Q of the basic circle of the involute curve forming the orbiting scroll wrap 13. On the other hand, the central point Fo of application of the pressing force FO acting on the orbiting scroll 8 from the side of the sealing member 19 moves so as to draw a circular orbit Do of a radius equal to the orbiting radius of the orbiting scroll 8 around a point P positioned on the central point O of the orbiting end plate 16.

The relationship among the pressing force FO, floating force FI, distance L, and overturning moment M relative to the orbiting angle of the orbiting scroll 8 is substantially the same as that shown in FIG. 11. Accordingly, when the floating force FI takes a maximum value or a value close thereto, the distance L takes a minimum value or a value close thereto, and when the floating force FI takes a minimum value or a value close thereto, the distance L takes a maximum value or a value close thereto, thus maintaining a maximum value Mmax of the overturning moment M small and considerably reducing the amount of change thereof.

An electrically-driven closed horizontal scroll compressor according to a fourth embodiment of the present invention is hereinafter discussed with reference to FIGS. 8 and 12. Description of elements having the same construction and operation as those of the second embodiment is omitted for brevity's sake.

A sealing member 19 is concentrically aligned with the orbiting end plate 16 and is received in a recess defined in the orbiting end plate 16 on a generally flat surface thereof opposite to the orbiting scroll wrap 13 and confronting the flat portion 18 of the generally ring-shaped bearing member 17. That region on the orbiting end plate 16 which is defined internally of the sealing member 19 receives the pressure of the high-pressure refrigerant discharged from the center discharge port 20 of the compression mechanism 2, while that region on the orbiting end plate 16 which is defined externally of the sealing member 19 receives the pressure of the low-pressure refrigerant introduced into the compression mechanism 2. The center of development, i.e., the center Q of a basic circle of an involute curve of a circle forming the orbiting scroll wrap 13 is positioned on the orbiting end plate 16 so that during the orbiting motion of the orbiting scroll 8, a distance L between a central point Fi of application of the floating force FI acting on the orbiting scroll 8 and a central point Fo of application of the pressing force FO may become minimum at an orbiting angle at which the magnitude of the floating force FI is equal to or nearly equally to a maximum value.

Figure 8:
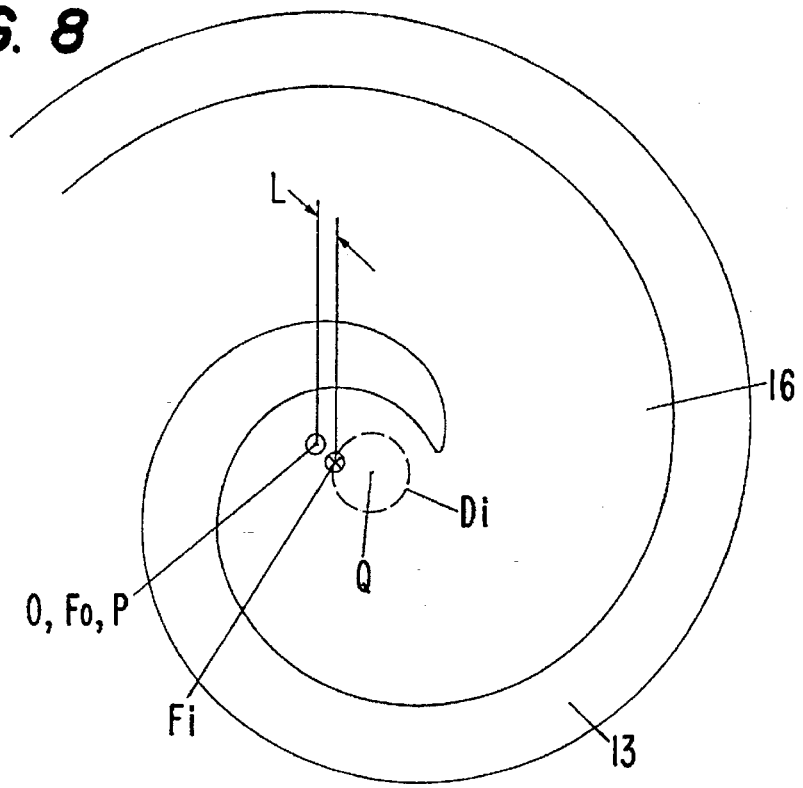
FIG. 8 is a view similar to FIG. 5, but according to a fourth embodiment of the present invention.

More specifically, as shown in FIG. 8 indicating a relationship between the floating force FI and the pressing force FO as viewed from the working pockets 15 towards the orbiting scroll wrap 13, the central point Fi of application of the floating force FI acting on the orbiting scroll 8 from the side of the working pockets 15 moves so as to draw a circular orbit Di of a radius equal to half the orbiting radius of the orbiting scroll 8 around the central point Q of the basic circle of the involute curve forming the orbiting scroll wrap 13. On the other hand, the central point Fo of application of the pressing force FO acting on the orbiting scroll 8 from the side of the sealing member 19 coincides with a point P positioned on the central point O of the orbiting end plate 16, because the sealing member 19 is mounted on the orbiting end plate 16.

The relationship among the pressing force FO, floating force FI, distance L, and overturning moment M relative to the orbiting angle of the orbiting scroll 8 is substantially the same as that shown in FIG. 12. Accordingly, when the floating force FI takes a maximum value or a value close thereto, the distance L takes a minimum value or a value close thereto, and when the floating force FI takes a minimum value or a value close thereto, the distance L takes a maximum value or a value close thereto, thus maintaining a maximum value Mmax of the overturning moment M small and considerably reducing the amount of change thereof.

Figure 9:
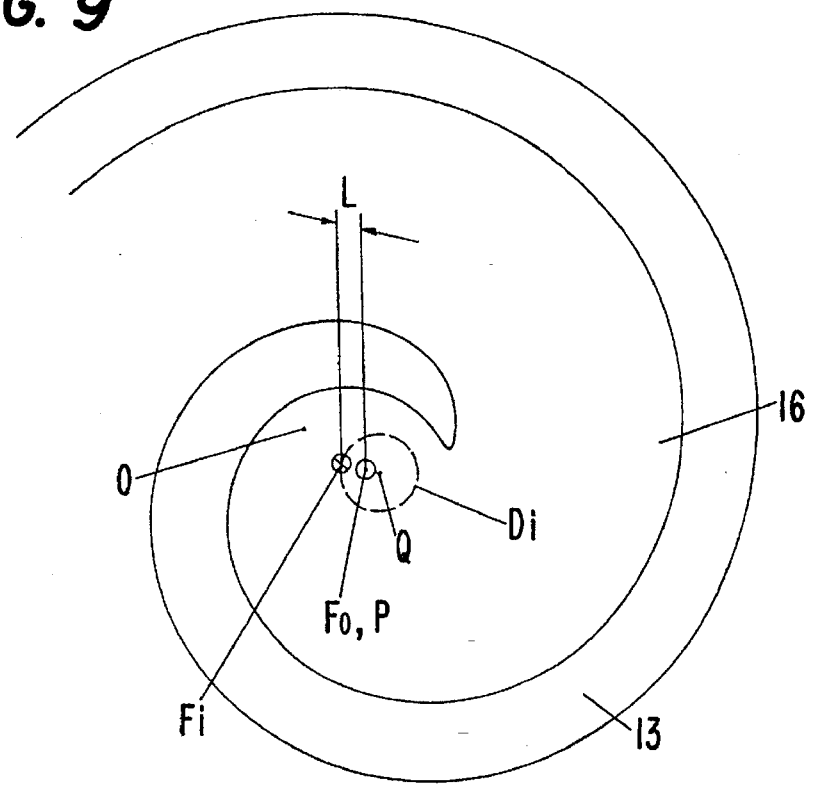
FIG. 9 is a view similar to FIG. 5, but according to a fifth embodiment of the present invention.
Figure 10:
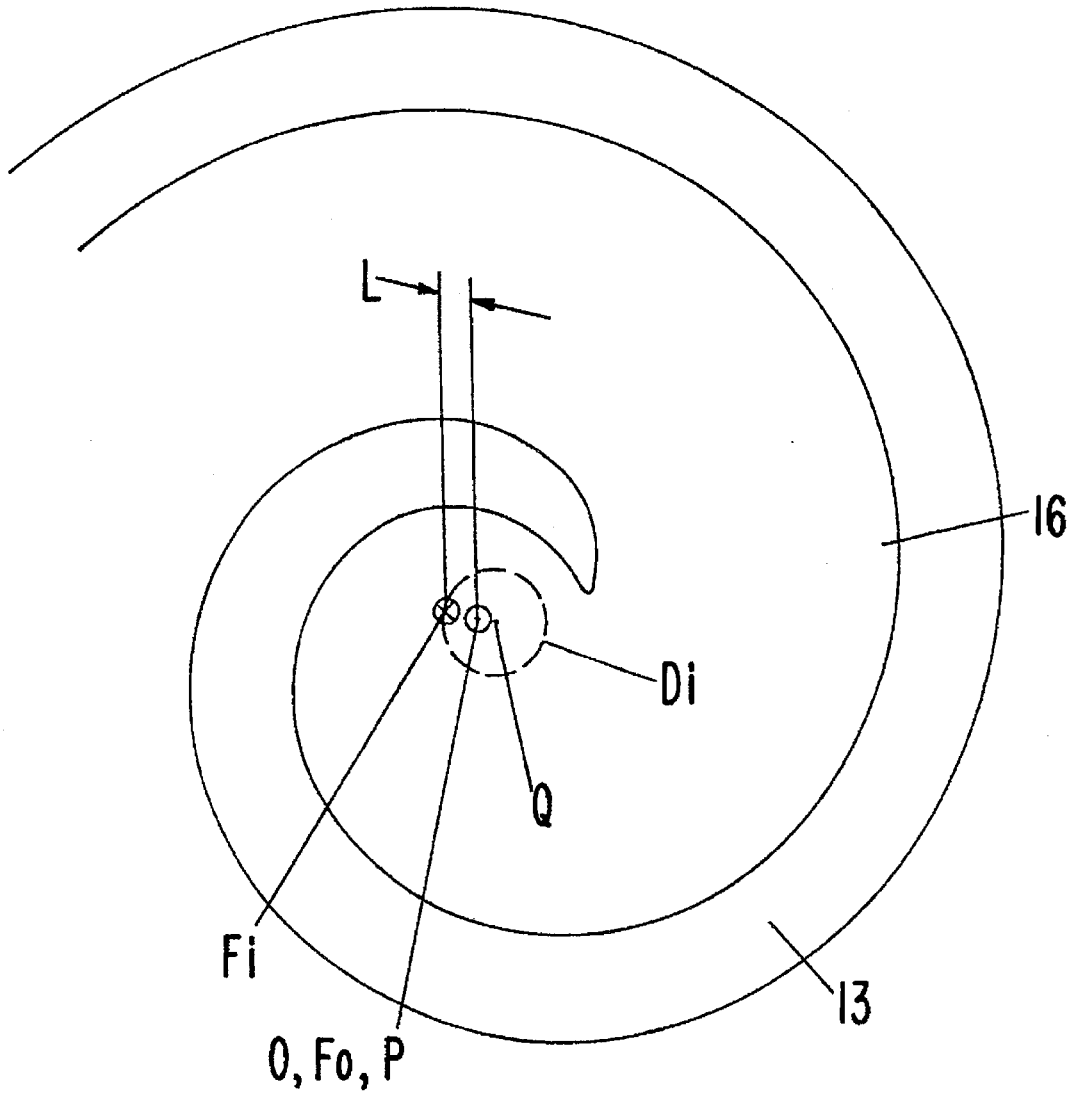
FIG. 10 is a view similar to FIG. 9, but indicating a modification thereof.

An electrically-driven closed horizontal scroll compressor according to a fifth embodiment of the present invention is hereinafter discussed with reference to FIGS. 9, 10 and 13.

This embodiment is somewhat similar to the second or fourth embodiment, but differs therefrom in that the central point Fo of application of the pressing force FO acting on the orbiting scroll 8 is positioned within the circular orbit Di which the central point Fi of application of the floating force FI acting on the orbiting scroll 8 draws during the orbiting motion of the orbiting scroll 8. Also, the central point Q of a basic circle of an involute curve of a circle forming the orbiting scroll wrap 13 is positioned on the orbiting end plate 16, while the sealing member 19 is mounted on the orbiting scroll 8 so that during the orbiting motion of the orbiting scroll 8, a distance L between a central point Fi of application of the floating force FI acting on the orbiting scroll 8 and a central point Fo of application of the pressing force FO may become minimum at an orbiting angle at which the magnitude of the floating force FI is equal to or nearly equally to a maximum value. Accordingly, the central point Fo of application of the pressing force FO always coincides with a central point P of a circular orbit resulting from the orbiting motion of the orbiting scroll 8, or with a point P positioned on the central point O of the orbiting end plate 16, as shown in Figs. 9 and 10 indicating a relationship between the floating force FI and the pressing force FO as viewed from the working pockets 15 towards the orbiting scroll wrap 13. On the other hand, the central point Fi of application of the floating force FI acting on the orbiting scroll 8 from the side of the working pockets 15 moves so as to draw a circular orbit Di of a radius equal to half the orbiting radius of the orbiting scroll 8 around the central point Q of the basic circle of the involute curve forming the orbiting scroll wrap 13. Furthermore, the central point Fo of application of the pressing force FO is always positioned within the circular orbit Di referred to above.

Figure 13:
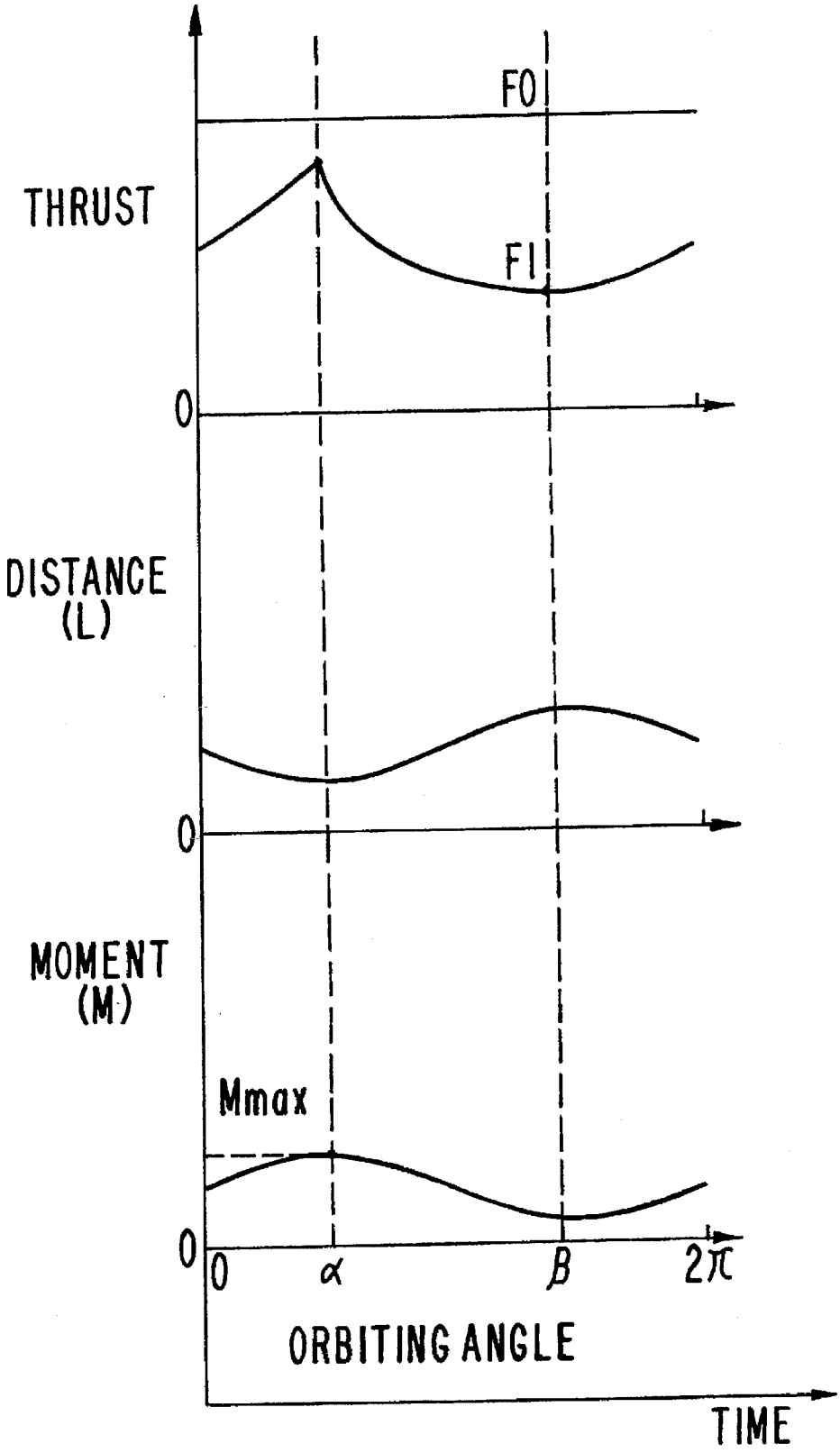
FIG. 13 is a graph similar to FIG. 11, but according to the fifth embodiment of the present invention.
Figure 14:
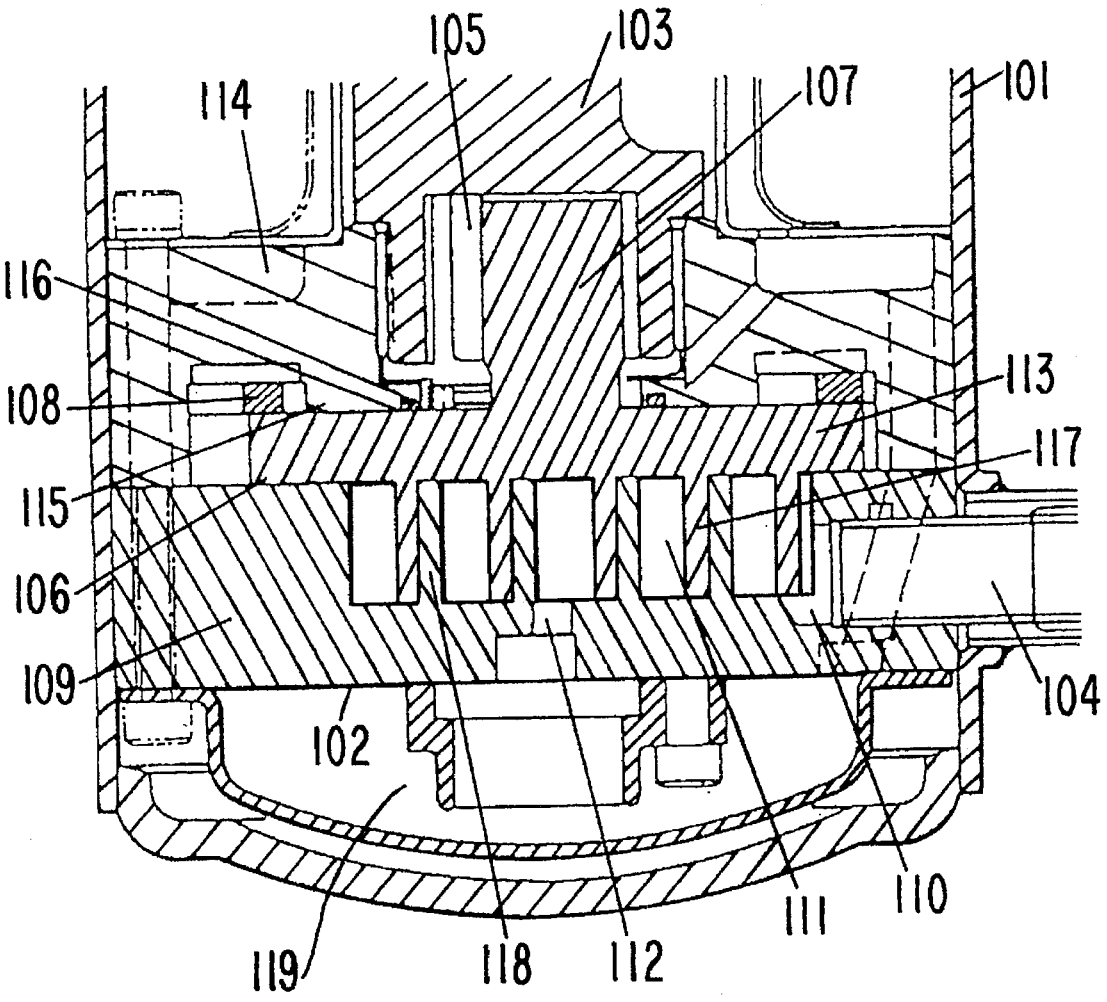
FIG. 14 (PRIOR ART)
FIG. 14 is a fragmentary vertical sectional view of a conventional electrically-driven closed horizontal scroll compressor.
Figure 15A:
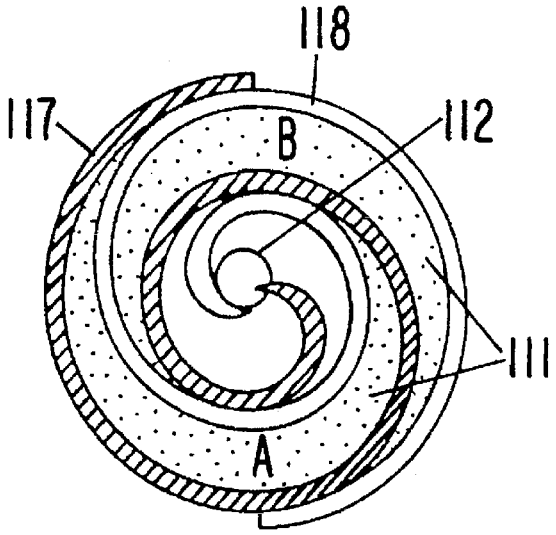
FIG. 15A (PRIOR ART)
FIGS. 15A, 15B, 15C, and 15D are schematic views of stationary and orbiting scrolls operatively accommodated in the conventional scroll compressor of FIG. 14 and being in engagement with each other, particularly indicating that the orbiting scroll undergoes an orbiting motion relative to the stationary scroll by 0°, 90°, 180°, and 270°, respectively.
Figure 15B:
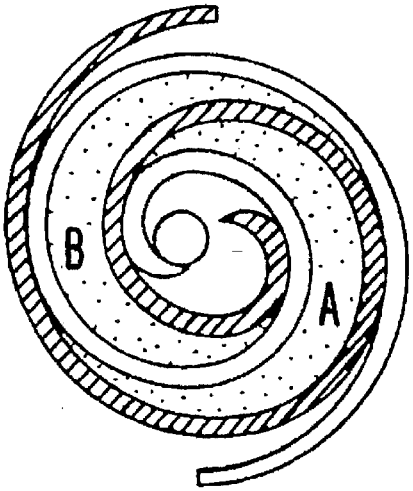
FIG. 15B (PRIOR ART)
Figure 15C:
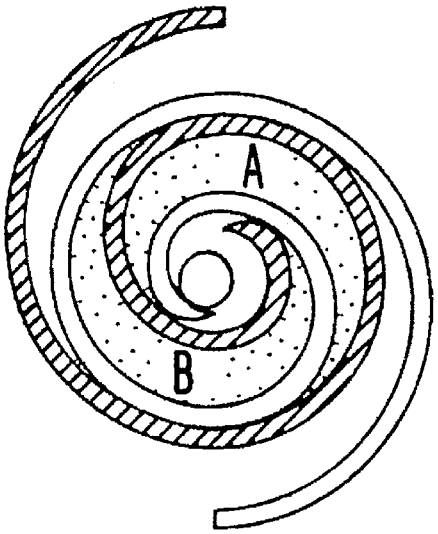
FIG. 15C (PRIOR ART)
Figure 15D:
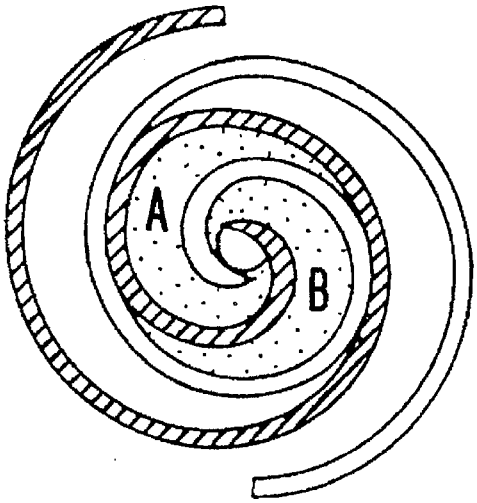
FIG. 15D (PRIOR ART)
Figure 16:
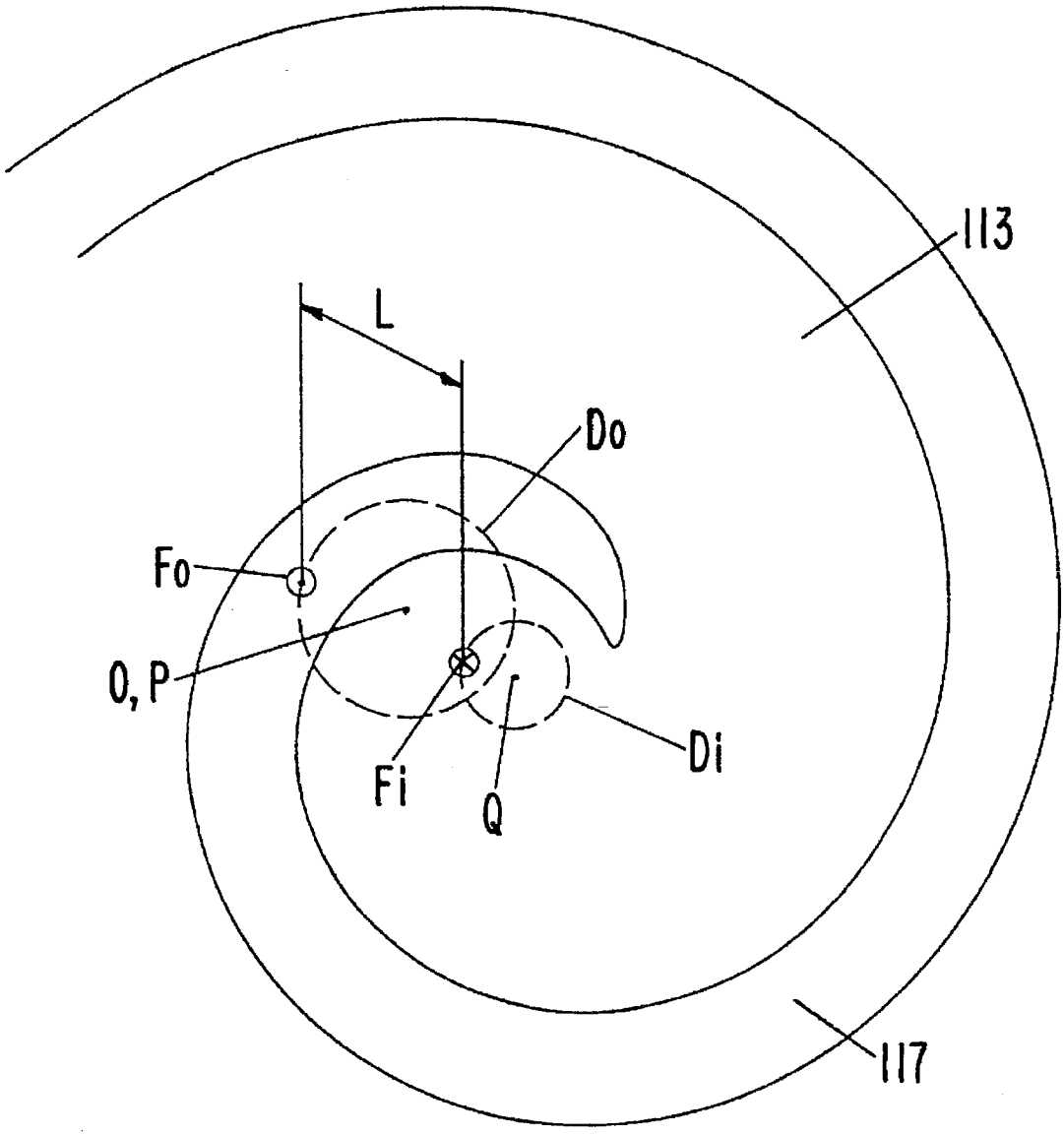
FIG. 16 (PRIOR ART)
FIG. 16 is a fragmentary front view of the orbiting scroll of FIGS. 15A to 15D, particularly indicating a relationship between a floating force and a pressing force both applied thereto.
Figure 17:
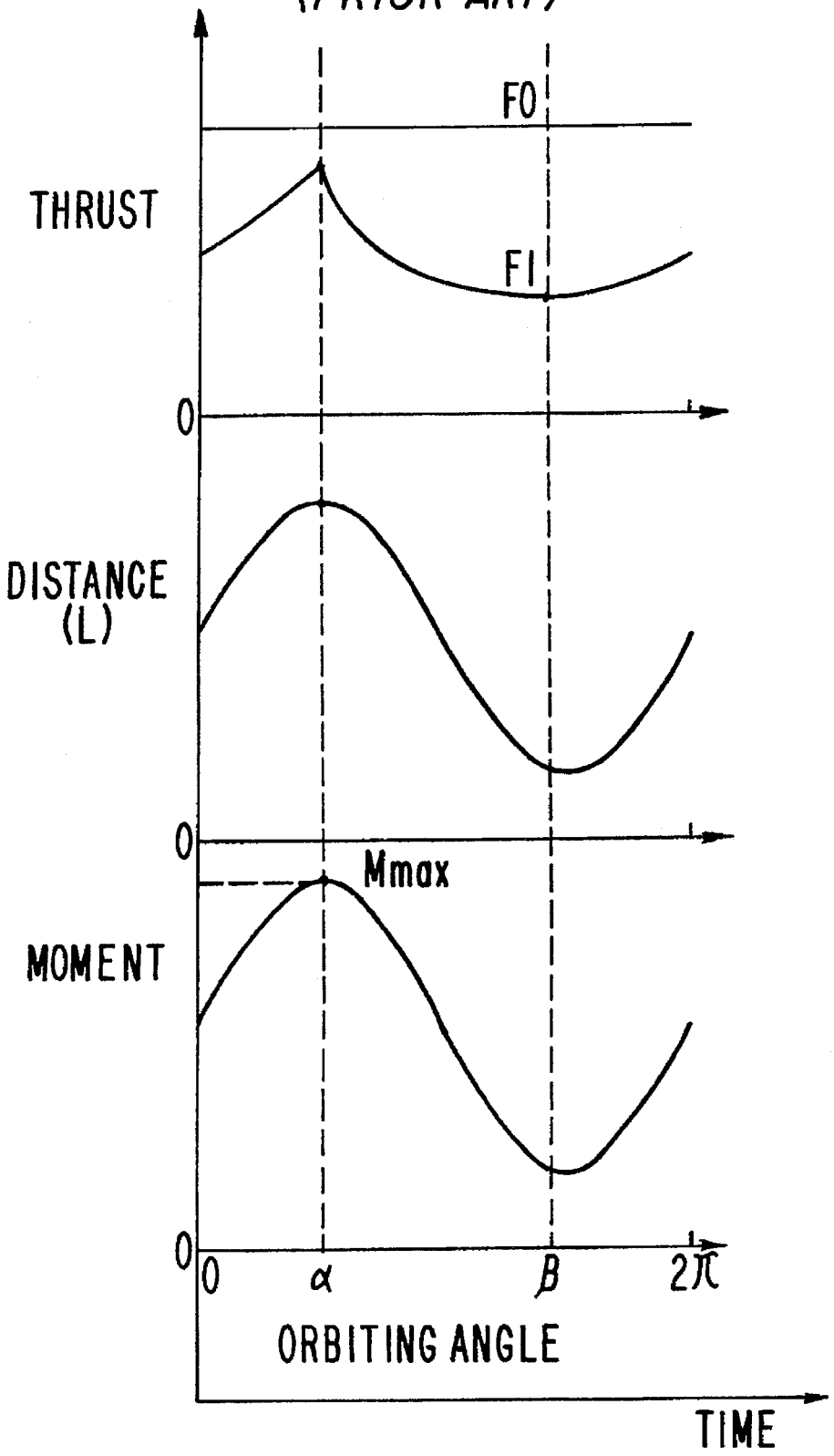
FIG. 17 (PRIOR ART)
FIG. 17 is a graph indicating thrust forces and a moment both applied to the orbiting scroll of FIG. 16.

FIG. 13 depicts a relationship among the pressing force FO, floating force FI, distance L, and overturning moment M relative to the orbiting angle of the orbiting scroll 8. When the floating force FI takes a maximum value at an orbiting angle of $\alpha^\circ$ or a value close thereto, the distance L takes a minimum value or a value close thereto, and when the floating force FI takes a minimum value or a value close thereto, the distance L takes a maximum value or a value close thereto. Also, because the distance L is limited within the range of the circular orbit Di, a maximum value Mmax of the overturning moment M can be maintained smaller than that in the second or fourth embodiment and, hence, the amount of change thereof can be further reduced.

Although in the above-described first to fifth embodiments the internal and external regions of the sealing member 19 mounted on either the bearing member 17 or the orbiting end plate 16 have been described as receiving the pressure of the high-pressure refrigerant discharged from the center discharge port 20 of the compression mechanism 2 and that of the low-pressure refrigerant introduced into the compression mechanism 2, respectively, each of them may receive a pressure other than the pressure of the refrigerant. Similar effects can be obtained, for example, by applying a pressure of a fluid medium other than the refrigerant to the internal region of the sealing member 19 and by applying a pressure of another fluid medium to the external region of the sealing member 19.

Also, the compression mechanism 2 may be so designed that the external region of the sealing member 19 receives an intermediate pressure between the pressure of the high-pressure refrigerant discharged from the center discharge port 20 and that of the low-pressure refrigerant introduced into the compression mechanism 2 by communicating the external region of the sealing member 19 with a high-pressure space inside the closed vessel 1 through a through-hole of a small diameter defined in the bearing member 17.

Furthermore, although the electrically-driven closed horizontal scroll compressor has been discussed in the above-described embodiments, the present invention is not limited thereto, but is equally applicable to an electrically-driven closed vertical scroll compressor.

In addition, the curve forming the orbiting and stationary scroll wraps 13 and 14 is not limited to an involute curve of a circle, but any other curve such as, for example, an involute curve of a polygon, an Archimedean curve or the like can be employed if the stationary scroll wrap is formed so as to represent an external envelope of a locus of the orbiting scroll wrap when the orbiting scroll undergoes an orbiting motion.

As is clear from the above, according to the present invention, the maximum overturning moment acting on the orbiting scroll and the amount of change thereof can be reduced by radially offsetting the center of the sealing member or by appropriately positioning the center of development of an involute curve forming the orbiting scroll wrap without increasing the diameter of the bearing member or without using any additional elements. As a result, no leakage of the compressed refrigerant takes place between neighboring working pockets, avoiding a reduction in volume efficiency. Also, no biased contact takes place between the orbiting shaft of the orbiting scroll and the eccentric bearing or between an outer peripheral portion of the orbiting end plate of the orbiting scroll and the stationary scroll, reducing wear and generating less noise and vibration.

Moreover, because no special means is required to apply a pressure to the internal region of the sealing member and another pressure to the external region of the sealing member, pressures of any desired magnitude can be readily obtained.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An electrically-driven closed scroll compressor comprising:

a closed vessel, a compression mechanism accommodated in said closed vessel and comprising, a bearing member securely mounted in said closed vessel, a stationary scroll having a stationary scroll wrap formed thereon, an orbiting scroll mounted between said stationary scroll and said bearing member and having an orbiting end plate and an orbiting scroll wrap formed on said orbiting end plate so as to engage with said stationary scroll wrap to define a plurality of working pockets therebetween, and an eccentric bearing for allowing said orbiting scroll to undergo an orbiting motion relative to said stationary scroll;

an electric motor accommodated in said closed vessel so as to drive said compression mechanism; and a generally ring-shaped sealing member mounted on one of said bearing member and said orbiting end plate so as to be held in contact with the other of said bearing member and said orbiting end plate;

wherein said orbiting end plate has first and second regions defined therein internally and externally of said sealing member, respectively, said first and second regions receiving first and second pressures, respectively, both forming a first thrust force; and wherein said sealing member has a center positioned relative to a center of said one of said bearing member and said orbiting end plate so as to constitute a means for causing, during the orbiting motion of said orbiting scroll and when a second thrust force applied to said orbiting scroll from said working pockets takes a substantially maximum value, a distance between a central point of application of said first thrust force and a central point of application of said second thrust force to take a substantially minimum value.

2. The scroll compressor according to claim 1, wherein the center of said sealing member is radially offset from a center of said bearing member.

3. The scroll compressor according to claim 1, wherein said first pressure is equal to a pressure of a high-pressure refrigerant discharged from said compression mechanism, while said second pressure is equal to a pressure of a low-pressure refrigerant introduced into said compression mechanism.

4. The scroll compressor according to claim 1, wherein said generally ring-shaped sealing member is mounted on said bearing member.

5. The scroll compressor according to claim 1, wherein said generally ring-shaped sealing member is mounted on said orbiting end plate.

* * * * *